United States Patent [19]

Plötze

[11] Patent Number: 4,482,469

[45] Date of Patent: Nov. 13, 1984

[54] CLEANING AGENT FOR FIRE-ARM BARRELS

[76] Inventor: Bodo Plötze, Amselweg 7, 8011 Vaterstetten, Fed. Rep. of Germany

[21] Appl. No.: 414,665

[22] Filed: Sep. 3, 1982

[30] Foreign Application Priority Data

Sep. 4, 1981 [DE] Fed. Rep. of Germany ..... 3135153

[51] Int. Cl.[3] ..... C11D 3/26; C11D 7/32

[52] U.S. Cl. ..... 252/155; 51/308; 252/541

[58] Field of Search ..... 51/309, 308; 134/8; 252/541, 544, 154, 155, 174.18, 117, 118, 119, 523, 525, 527, 174.23, 174.24, 174.25; 106/3, 5

[56] References Cited

U.S. PATENT DOCUMENTS

| | | | |
|---|---|---|---|
| 2,865,725 | 12/1958 | Schroeder et al. | 51/309 |
| 3,425,870 | 2/1969 | Marsh | 51/309 |
| 3,652,420 | 3/1972 | Hill | 252/541 |
| 3,903,410 | 9/1975 | Akrongold et al. | 252/117 |
| 3,915,880 | 10/1975 | Sepulveda | 252/541 |
| 4,069,066 | 1/1978 | Hindle et al. | 252/544 |
| 4,135,947 | 1/1979 | Rink | 252/544 |
| 4,182,686 | 1/1980 | Laks et al. | 252/119 |
| 4,226,623 | 10/1980 | Koshiyama | 51/309 |
| 4,315,780 | 2/1982 | Rupp et al. | 134/8 |
| 4,369,071 | 1/1983 | Flach et al. | 134/8 |

*Primary Examiner*—Paul Lieberman
*Assistant Examiner*—W. Thompson
*Attorney, Agent, or Firm*—Ostrolenk, Faber, Gerb & Soffen

[57] ABSTRACT

Cleaning agent for fire-arm barrels based on ammonia or amine compounds, in particular for the removal of abraded shot or bullet material. In order to achieve a simple and non-dangerous application and to improve storability, the ammonia or amine compound is contained in a high viscosity gel. An improved cleaning action can be achieved when the gel additionally contains a grinding and polishing agent with a mechanical effect, for example cerium oxide or very finely pulverized silicon dioxide.

9 Claims, No Drawings

CLEANING AGENT FOR FIRE-ARM BARRELS

The invention relates to a cleaning agent for fire-arm barrels, based on compounds of ammonia or amine, in particular for the removal of abraded shot or bullet material.

Abraded shot or bullet material of this kind consisting of lead, copper or tombac, was previously removed with solutions containing ammonia, which were poured into the barrel of the weapon, the barrel having to be closed with corks or rubber cloth so that the solution containing ammonia did not evaporate and did not run out. This solution had to be allowed to act for a long time inside the barrel and was then poured out, whereupon the barrel was subsequently cleaned with weapon tow.

This method of cleaning fire-arm barrels gives rise to a great danger of burning the skin, eyes and nostrils. In particular, when pouring out the solution containing ammonia, a large evaporating surface develops in the sink. This evaporating surface gives off ammonia gas copiously and can lead to respiratory injuries. Furthermore, the storage of such solutions containing ammonia is difficult and it has become apparent that, after a certain time, the majority of the ammonia gas has escaped from the containers, for the most part via the seal, so that the cleaning agent is no longer effective.

The invention is based on the problem of providing a cleaning agent of the initially named kind, which is simpler and less dangerous to use and which enables longer storage with impeccable cleaning of the fire-arm barrel.

This problem is solved by the invention given in the characterizing part of claim 1.

Advantageous arrangements and further developments of the invention follow from the sub-claims.

Owing to the fact that, in accordance with the invention, the ammonia or amine compound is contained in a gel, the ammonia gas can only evaporate on a very small scale, so that, in relation to the amount of ammonia, only a small amount of noxious and unpleasant vapour is given off. Storage of the cleaning agent is thus also simpler, because gel adhering to the point of closure of a container prevents the loss of ammonia through evaporation. In this way, the effectiveness of the cleaning agent is preserved for a very long time. The addition of the potassium hydroxide solution enables significantly improved effectiveness of the cleaning agent with abraded lead particles.

Furthermore, alkali and alkaline earth salts of ethylenediaminetetraacetic acid of potassium oleate and salts of napthenic acid can be added to the cleaning agent in order to improve the effectiveness of the cleaning.

The addition of a warning dye results in the advantage that residues in the interior of the barrel can very easily be recognized and removed.

The cleaning agent in accordance with the invention adheres very well to the interior walls where a very pronounced cleaning action develops.

The addition of glycerin prevents the gel drying out and achieves a certain lubricity, which makes the application easier. An additional mechanical grinding and polishing effect can be achieved by adding a grinding and polishing agent with a mechanical effect to the gel.

This grinding and polishing agent can be formed by cerium oxide or by very finely pulverized silicon dioxide. The invention will be explained in further detail in the following, with the aid of examples:

Examples for the manufacture of an initial gel will firstly be given:

EXAMPLE 1

For the manufacture of a pre-determined amount (100%) of an initial gel, 0.8% to 2% of carboxyvinyl polymer are mixed with approximately 65% water, to which approximately 25% of aqueous ammonia solution are added, in order to form a gel. Approximately 8% glycerin and/or fluorescine sodium or another distinctive warning dye are also added to this gel to form the initial gel.

EXAMPLE 2

The same manufacturing steps as used in Example 1 are used for the manufacture of the initial gel, however, up to 25% triethanolamine or diethanolamine are added in place of the amount of 25% aqueous ammonia solution.

EXAMPLE 3

The same manufacturing steps are used for the manufacture of the initial gel as those used in Example 1, however, 25% of a 15% $Na_2CO_3$ solution (soda) or $K_2CO_3$ solution (potash) is added, in place of the aqueous ammonia solution in the amount of 25%.

EXAMPLE 4

Once again, the same manufacturing steps are used for the manufacture of the initial gel as those used in Example 1, however, the 25% ammonia solution is replaced by 10% ethylene diamine and a further 15% water.

EXAMPLE 5

In place of the addition of the aqueous ammonia solution, ammonia gas can also be guided through the mixture of carboxyvinyl and water, wherein the gas is absorbed up to a certain concentration. The remaining manufacturing steps including the addition of the glycerin and optionally of the warning dye, remain the same.

In all the above examples, a carboxyvinyl polymer was used as a base for the initial gel. However, other gel formers could also be used, by way of example, carboxymethylcellulose. In this case however, the addition of ammonia solution or triethanolamine, diethanolamine or ethylendiamine or soda or potash, is not needed for the gelation, but can be replaced by water. The following examples can be given for the manufacture of the finished gel:

EXAMPLE 6

An aqueous solution of KOH in water is manufactured by dissolving approximately 3 to 4 g. KOH in 15 ml. of water. This aqueous solution is mixed into an amount of 85 g. of the initial gel, wherein the amount of water used for the preparation of the initial gel can, if necessary, be reduced, in order to achieve a gel of correspondingly higher or lower viscosity.

The initial gel using carboxyvinyl polymer as such already has an excellent cleaning effect and already releases (dissolves) abraded material of copper and copper compounds such as tombac (pinchbeck). Furthermore, acidic powder residues are neutralized. The addition of KOH simultaneously brings about the release (dissolution) of abraded particles.

This dissolution of abraded lead particles can also be achieved according to Example 7:

EXAMPLE 7

Potassium oleate in an amount of 16% is added to the initial gel, either in place of the aqueous solution of KOH, in accordance with Example 6, or in addition to this. Hereby, rust deposits are also effectively removed.

The same applies to the Examples 8 and 9.

EXAMPLE 8

Alkali and/or alkaline earth salts of ethylenediaminetetraacetic acid can also be added to the initial gel in an amount of at least 5% in place of the potassium oleate of Example 7.

EXAMPLE 9

Salts of napthenic acid are added in place of the potassium oleate of Example 7.

A small amount of a grinding and polishing agent with a mechanical effect can be added to the gel in all the examples. This grinding or polishing agent can, by way of example, be cerium oxide or very finely pulverized silicon dioxide.

I claim:

1. Cleaning agent for fire-arm barrels based on ammonia, in particular for the removal of abraded shot or bullet material, characterized in that, the ammonia is contained in a high viscosity gel containing potassium hydroxide and a dye.

2. Cleaning agent in accordance with claim 1 and characterized in that the gel contains the ammonia in the form of an aqueous ammonia solution.

3. Cleaning agent in accordance with claim 1 and characterized in that the gel contains ammonia gas, which is blown through the initial constituents of the gel.

4. Cleaning agent in accordance with claim 1 and characterized in that the gel is manufactured from a colloidal carboxyvinyl polymer of high molecular weight.

5. Cleaning agent in accordance with claim 1 and characterized in that the gel contains glycerin.

6. Cleaning agent in accordance with claim 1 and characterized in that the gel contains caustic potash (potassium hydroxide solution) in a concentration of up to 3.8%.

7. Cleaning agent in accordance with claim 1 and characterized in that the gel contains a grinding and polishing agent with a mechanical effect which is very finely pulverized silicon dioxide.

8. Cleaning agent in accordance with claim 1 and characterized in that the cleaning agent contains at least one alkali and/or alkaline earth salts of ethylenediaminetetraacetic acid.

9. Cleaning agent in accordance with claim 1 or 6 and characterized in that the cleaning agent contains salts of napthenic acid.

* * * * *